US009138076B2

(12) United States Patent
Hardy

(10) Patent No.: US 9,138,076 B2
(45) Date of Patent: Sep. 22, 2015

(54) PRODUCT MANAGEMENT DISPLAY SYSTEM

(71) Applicant: RTC Industries, Inc., Rolling Meadows, IL (US)

(72) Inventor: Stephen N. Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 14/262,420

(22) Filed: Apr. 25, 2014

(65) Prior Publication Data

US 2015/0208830 A1 Jul. 30, 2015

Related U.S. Application Data

(60) Provisional application No. 61/931,404, filed on Jan. 24, 2014.

(51) Int. Cl.

| | |
|---|---|
| ***A47F 1/04*** | (2006.01) |
| ***A47F 5/00*** | (2006.01) |
| ***A47F 1/12*** | (2006.01) |

(52) U.S. Cl.

CPC ..... *A47F 5/005* (2013.01); *A47F 1/126* (2013.01); *A47F 1/04* (2013.01)

(58) Field of Classification Search

CPC ..... A47F 1/126; A47F 1/04; A47F 3/002; A47F 5/0861

USPC ..... 211/59.2, 59.3, 59.4, 88.02, 126.16; 312/45, 61, 72; 108/61

See application file for complete search history.

(56) References Cited

U.S. PATENT DOCUMENTS

| | | | | | |
|---|---|---|---|---|---|
| 3,308,964 | A * | 3/1967 | Pistone | 211/184 |
| 3,680,177 | A * | 8/1972 | Ginsberg | 220/533 |
| 5,366,099 | A * | 11/1994 | Schmid | 211/59.3 |
| 5,458,248 | A * | 10/1995 | Alain | 211/175 |
| 5,634,564 | A * | 6/1997 | Spamer et al. | 211/59.3 |
| 5,855,283 | A * | 1/1999 | Johnson | 211/59.3 |
| 6,068,142 | A * | 5/2000 | Primiano | 211/183 |
| 6,227,385 | B1 * | 5/2001 | Nickerson | 211/59.3 |
| 6,679,389 | B1 * | 1/2004 | Robertson et al. | 211/59.2 |
| 6,719,152 | B1 * | 4/2004 | Nagel et al. | 211/59.3 |
| 6,964,235 | B2 * | 11/2005 | Hardy | 108/61 |

(Continued)

FOREIGN PATENT DOCUMENTS

| | | | |
|---|---|---|---|
| DE | 202011107980 | U1 | 1/2012 |
| WO | 2013066686 | A1 | 5/2013 |

OTHER PUBLICATIONS

Jul. 13, 2015—(PCT) International Search Report—PCT/US2015/012637

*Primary Examiner* — Joshua J Michener
*Assistant Examiner* — Devin Barnett
(74) *Attorney, Agent, or Firm* — Banner & Witcoff, Ltd.

(57) ABSTRACT

An adjustable tray for a merchandise display system may include a retainer for limiting the movement of products loaded in the adjustable tray, a pusher mechanism configured to bias product toward the retainer, a first divider extending from a first panel and second divider extending from a second panel. The spacing between the first divider and the second divider can be configured to be adjusted. The first panel and the second panel can be configured to move to provide additional surface area for the adjustable tray to accommodate different sized products.

9 Claims, 10 Drawing Sheets

(56) References Cited

U.S. PATENT DOCUMENTS

| | | | | |
|---|---|---|---|---|
| 7,086,541 | B2 * | 8/2006 | Robertson | 211/59.3 |
| 7,424,957 | B1 * | 9/2008 | Luberto | 211/59.3 |
| 7,458,473 | B1 * | 12/2008 | Mason | 211/59.3 |
| 7,628,282 | B2 * | 12/2009 | Hardy | 211/59.3 |
| 7,641,057 | B2 * | 1/2010 | Mueller et al. | 211/59.3 |
| 7,823,749 | B2 * | 11/2010 | Kelly | 221/178 |
| 7,854,334 | B2 * | 12/2010 | Nagel et al. | 211/59.3 |
| 7,918,353 | B1 * | 4/2011 | Luberto | 211/59.3 |
| 7,931,156 | B2 * | 4/2011 | Hardy | 211/59.3 |
| 8,210,367 | B2 * | 7/2012 | Nagel et al. | 211/88.02 |
| 8,317,038 | B2 * | 11/2012 | Luberto et al. | 211/59.3 |
| 8,851,303 | B2 * | 10/2014 | Crawbuck et al. | 211/59.3 |
| 2003/0085187 | A1 * | 5/2003 | Johnson et al. | 211/59.3 |
| 2003/0217980 | A1 * | 11/2003 | Johnson et al. | 211/59.3 |
| 2004/0004047 | A1 * | 1/2004 | Nagel et al. | 211/59.3 |
| 2004/0079715 | A1 | 4/2004 | Richter et al. | |
| 2004/0140278 | A1 * | 7/2004 | Mueller et al. | 211/59.3 |
| 2005/0077259 | A1 * | 4/2005 | Menz | 211/59.3 |
| 2005/0092702 | A1 * | 5/2005 | Nagel | 211/59.3 |
| 2005/0166806 | A1 * | 8/2005 | Hardy | 108/61 |
| 2006/0186064 | A1 * | 8/2006 | Merit et al. | 211/59.3 |
| 2006/0186065 | A1 * | 8/2006 | Ciesick | 211/59.3 |
| 2006/0260518 | A1 * | 11/2006 | Josefsson et al. | 108/61 |
| 2007/0170127 | A1 * | 7/2007 | Johnson | 211/59.3 |
| 2007/0175839 | A1 * | 8/2007 | Schneider et al. | 211/59.3 |
| 2010/0012602 | A1 * | 1/2010 | Valiulis et al. | 211/59.3 |
| 2010/0089847 | A1 * | 4/2010 | Rataiczak et al. | 211/59.3 |
| 2010/0107670 | A1 * | 5/2010 | Kottke et al. | 62/250 |
| 2011/0139736 | A1 * | 6/2011 | Hardy | 211/59.3 |
| 2013/0112634 | A1 * | 5/2013 | Nagel | 211/59.3 |
| 2013/0193095 | A1 * | 8/2013 | Nagel | 211/59.3 |
| 2014/0319086 | A1 * | 10/2014 | Sosso et al. | 211/59.3 |
| 2014/0319088 | A1 * | 10/2014 | Neumann et al. | 211/59.3 |
| 2015/0068991 | A1 * | 3/2015 | Kostka | 211/59.3 |

* cited by examiner

PRODUCT MANAGEMENT DISPLAY SYSTEM

CROSS REFERENCE TO RELATED APPLICATION

This Application claims priority to U.S. Provisional Application No. 61/931,404, filed on Jan. 24, 2014, which is incorporated fully herein by reference

FIELD

The exemplary embodiments herein relate generally to a shelf assembly for use in merchandising product and more particularly to an adjustable shelf assembly for displaying and pushing product on shelves.

BACKGROUND

Retail and wholesale stores, such as convenience stores, drug stores, grocery stores, discount stores, and the like, require a large amount of shelving both to store product and to display the product to consumers. In displaying product, it may be desirable for the product on the shelves to be situated toward the front of the shelf so that the product is visible and accessible to consumers. In the case of coolers or refrigerators that are used to store and display such products as soft drinks, energy drinks, bottled water, and other bottled or canned beverages, it may be desirable for these products to also be situated toward the front of the shelf and visible and accessible to the consumers.

To accomplish this placement of product, systems may include inclined trays or floors that through gravity will cause the product to move toward the front of the shelf. Many of these systems include floors or shelves made of a plastic material such as polypropylene that due its low coefficient of friction permit the product to easily slide along the inclined floor or surface. Other systems may include the use of a pusher system to push the product toward the front of the shelf as the product at the front of the shelf is removed. Pusher systems may be mounted to a track and may include a pusher paddle and a coiled spring to urge the product forward.

SUMMARY

In one example a merchandise display system may include one or more of: a retainer for limiting the movement of products loaded in a tray, a pusher mechanism configured to bias product toward the retainer, a first divider extending from a first panel and second divider extending from a second panel. In one example, the spacing between the first divider and the second divider can be configured to be adjusted. In addition or in the alternative, the retainer may include a retainer wall for retaining products in a first position and a retainer projection configured to retain existing products on the shelf in a second position and to serve as a guide for products being loaded into the tray.

Figure 1:
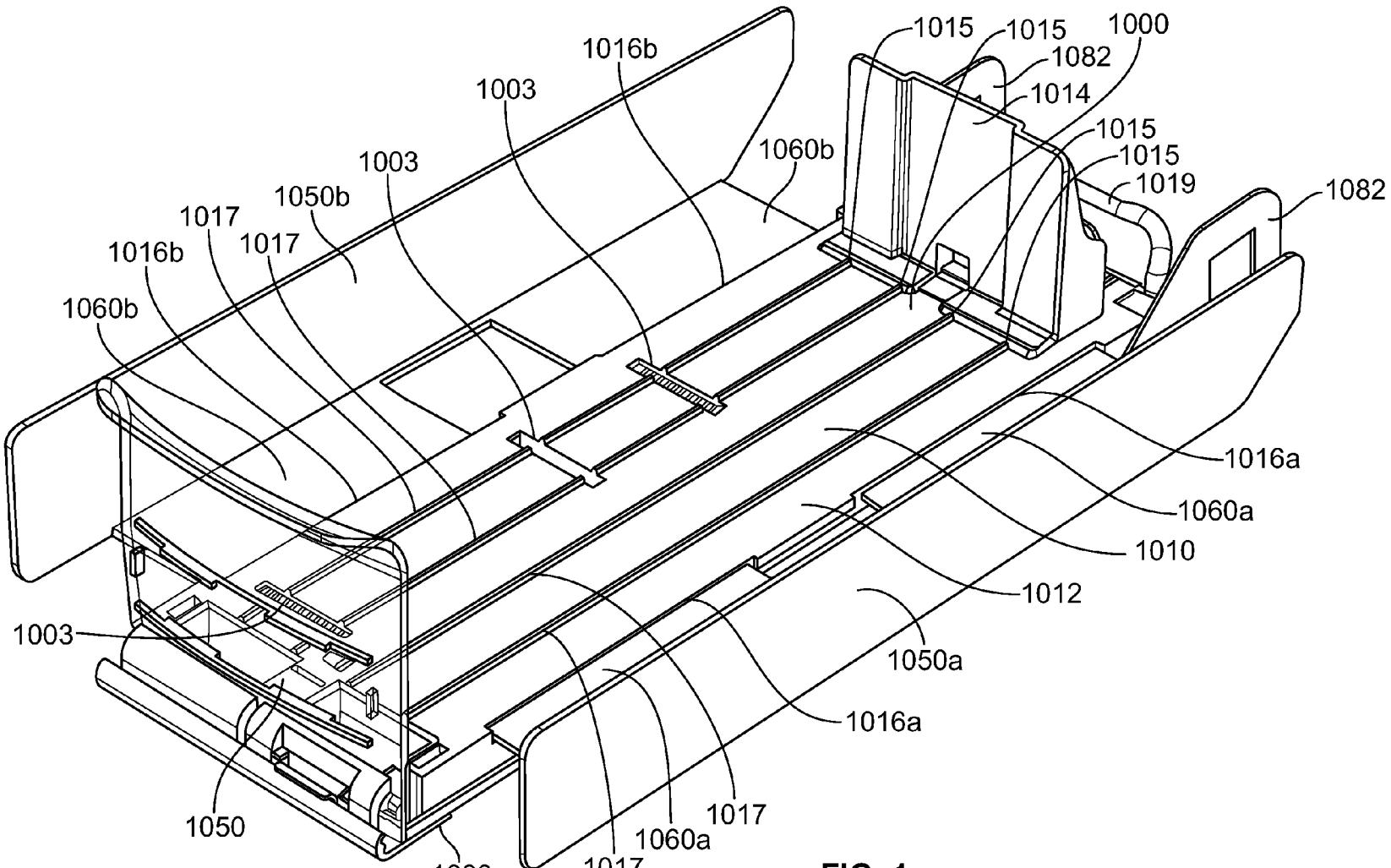
FIG. 1 depicts an example of product management display system for merchandising product on an adjustable tray in an extended position.

Before the examples are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, the use of the term "mount," "mounted" or "mounting" is meant to broadly include any technique or method of mounting, attaching, joining or coupling one part to another, whether directly or indirectly.

DETAILED DESCRIPTION

Figure 2:
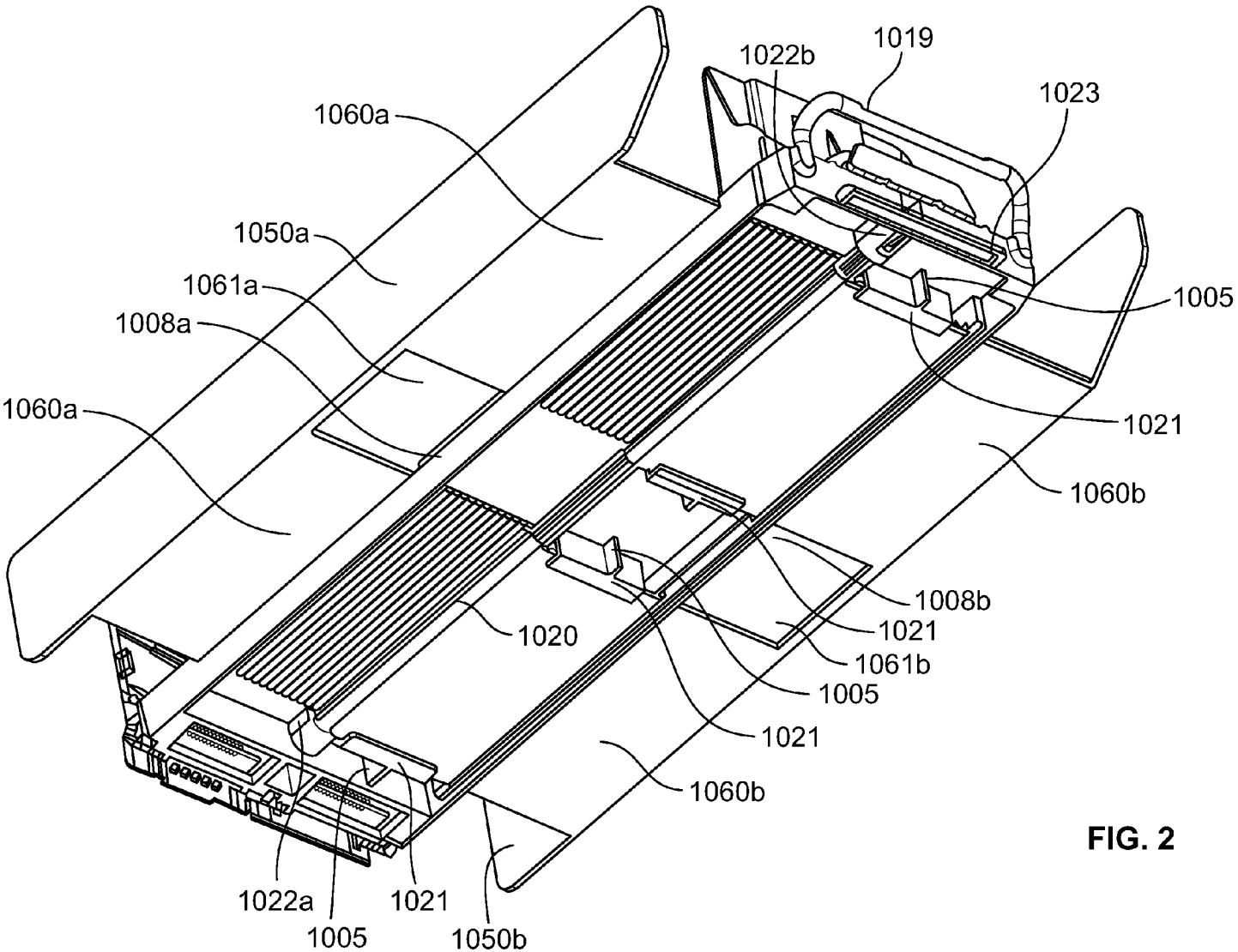
FIG. 2 shows a bottom view of the adjustable tray of FIG. 1 in an extended position.
Figure 3:
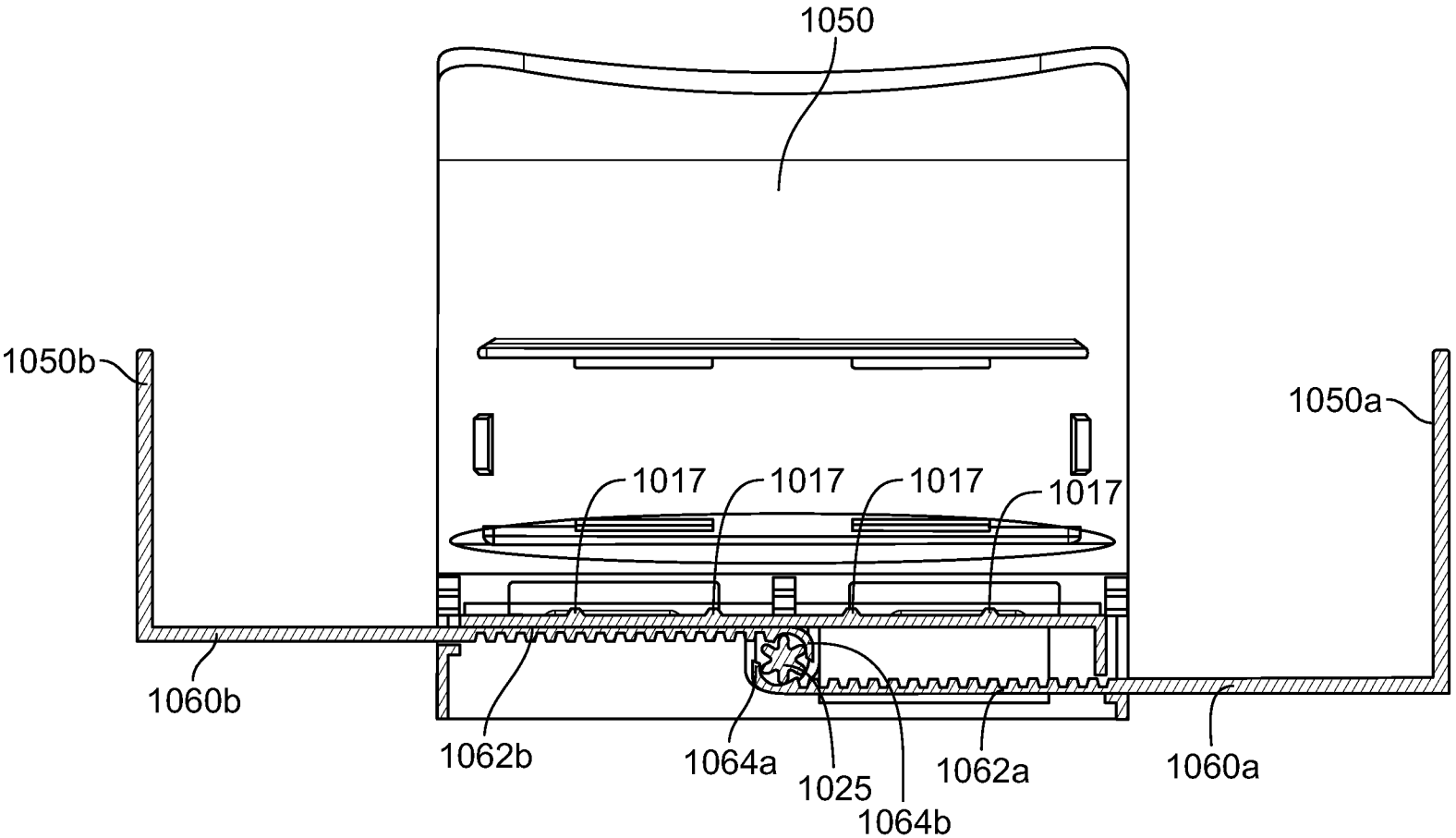
FIG. 3 shows a front view of the adjustable tray of FIG. 1.
Figure 4:
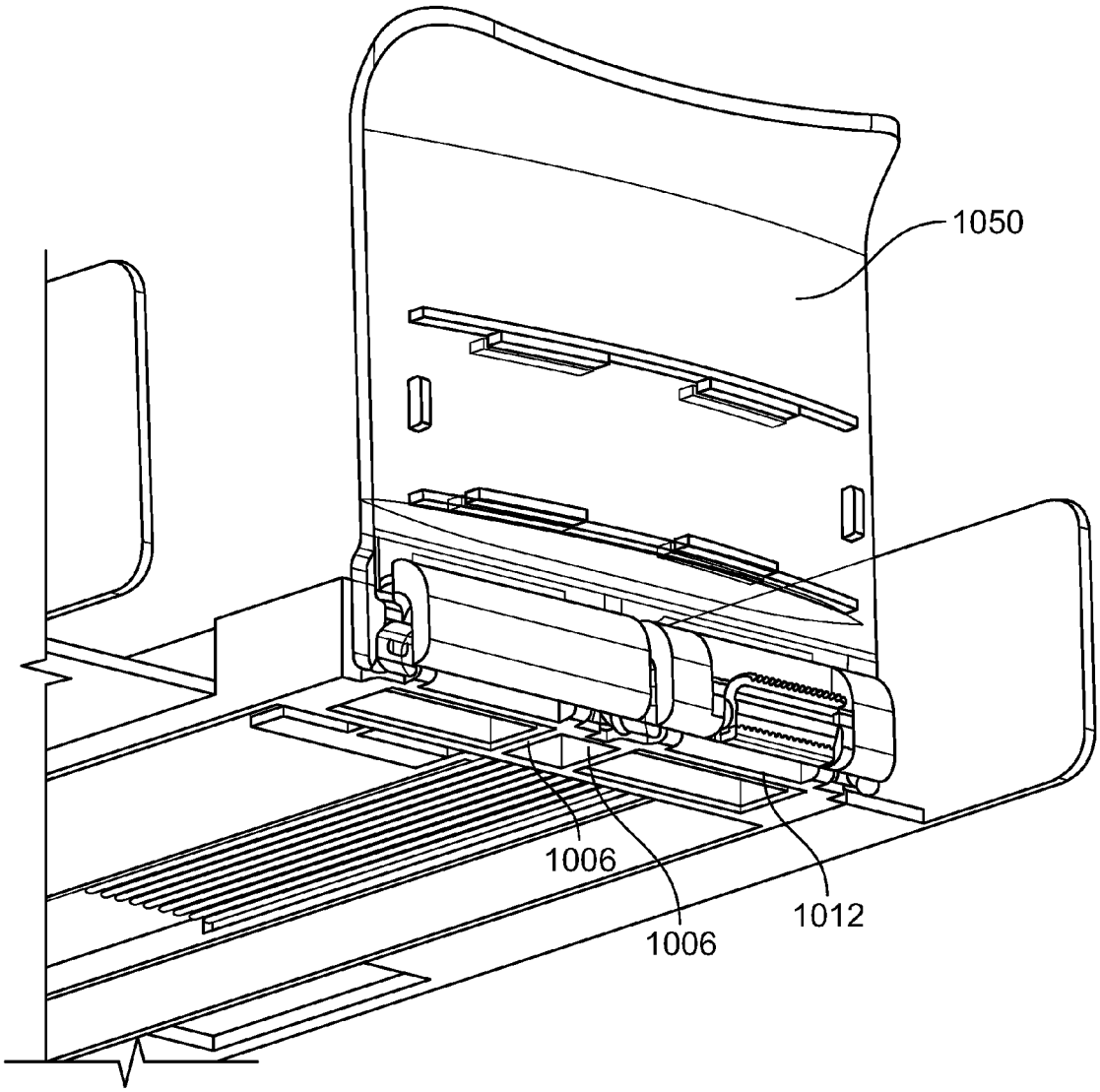
FIG. 4 shows a front perspective view of the adjustable tray of FIG. 1.
Figure 5B:
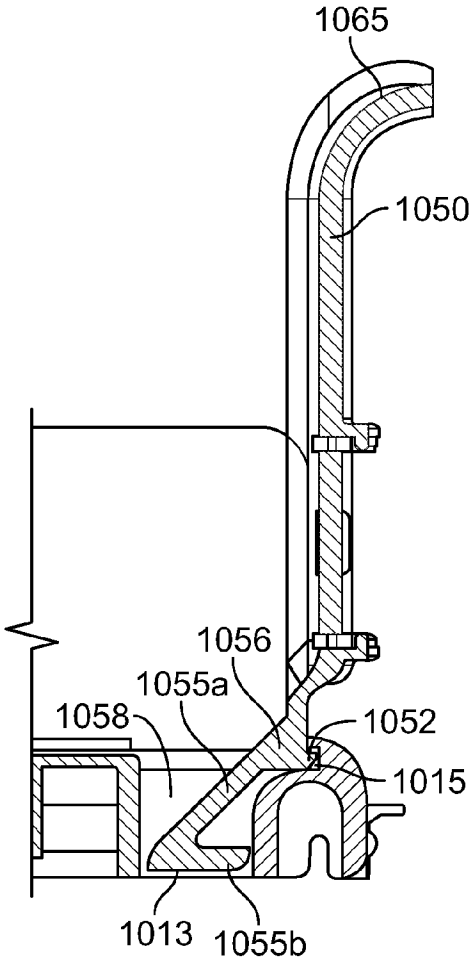
FIGS. 5*a* and 5*b* show cross-sectional views of a front portion of the adjustable tray of FIG. 1 in a first configuration and in a second configuration.
Figure 5A:
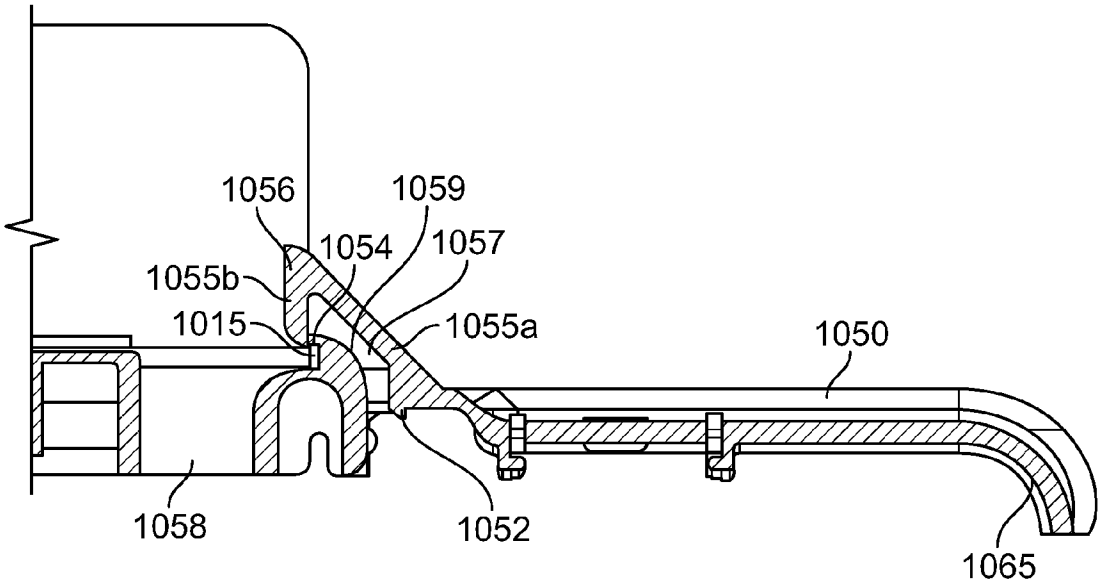
Figure 6A:
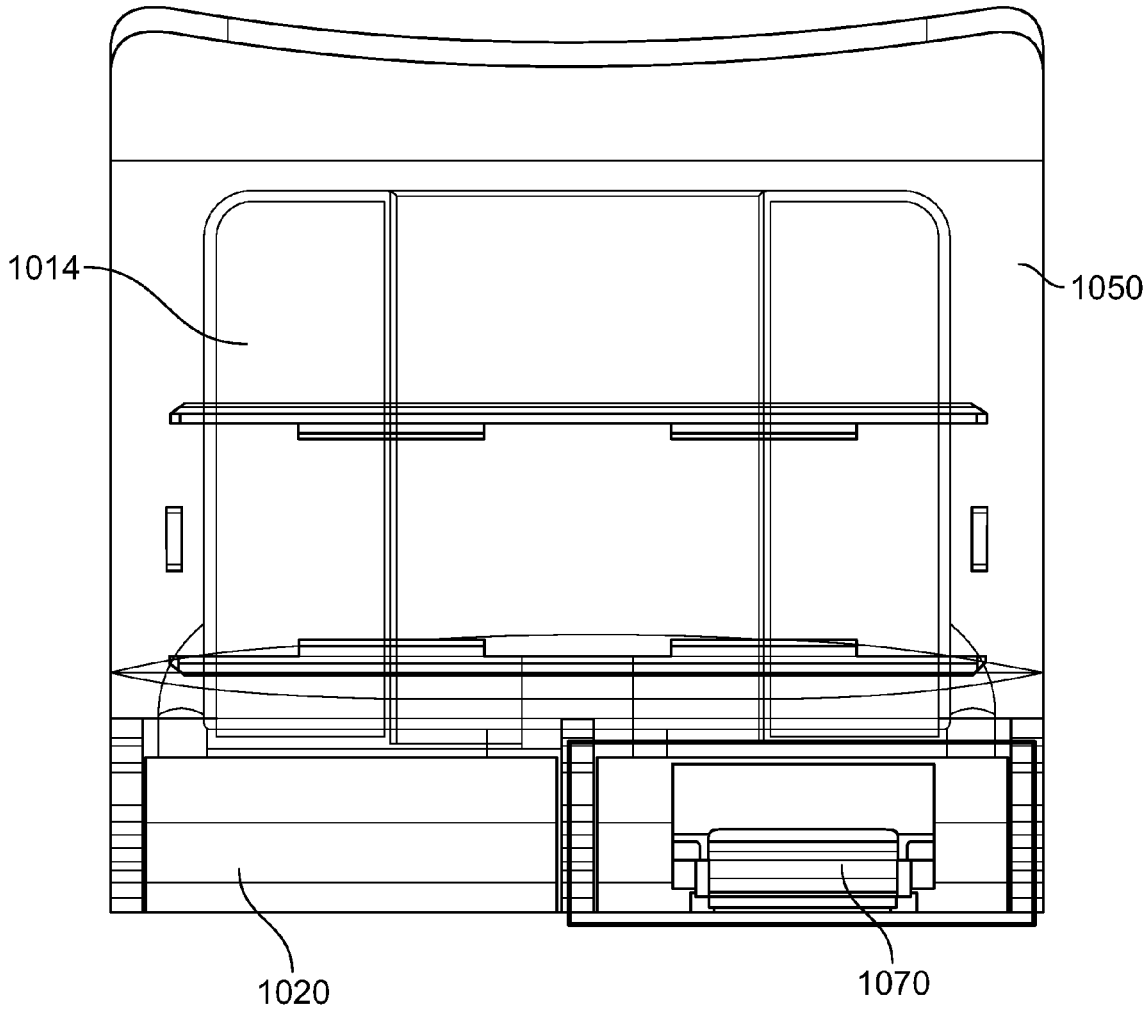
FIG. 6*a* shows a front view of the adjustable tray of FIG. 1 and an exemplary cam for securing the adjustable tray of FIG. 1 into place.
Figure 6B:
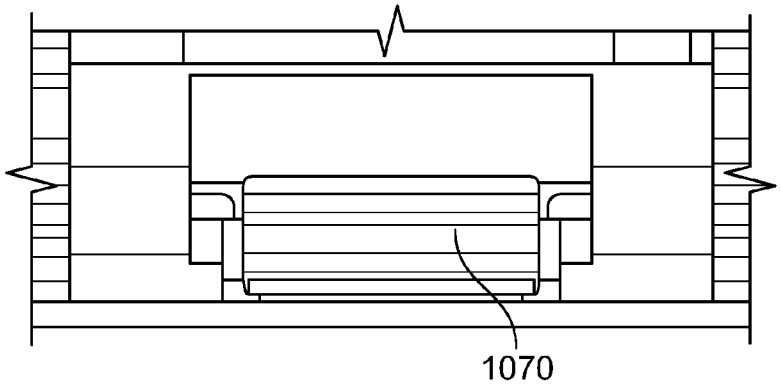
FIG. 6*b* is a magnified view of the portion identified in FIG. 6*a*.
Figure 7:
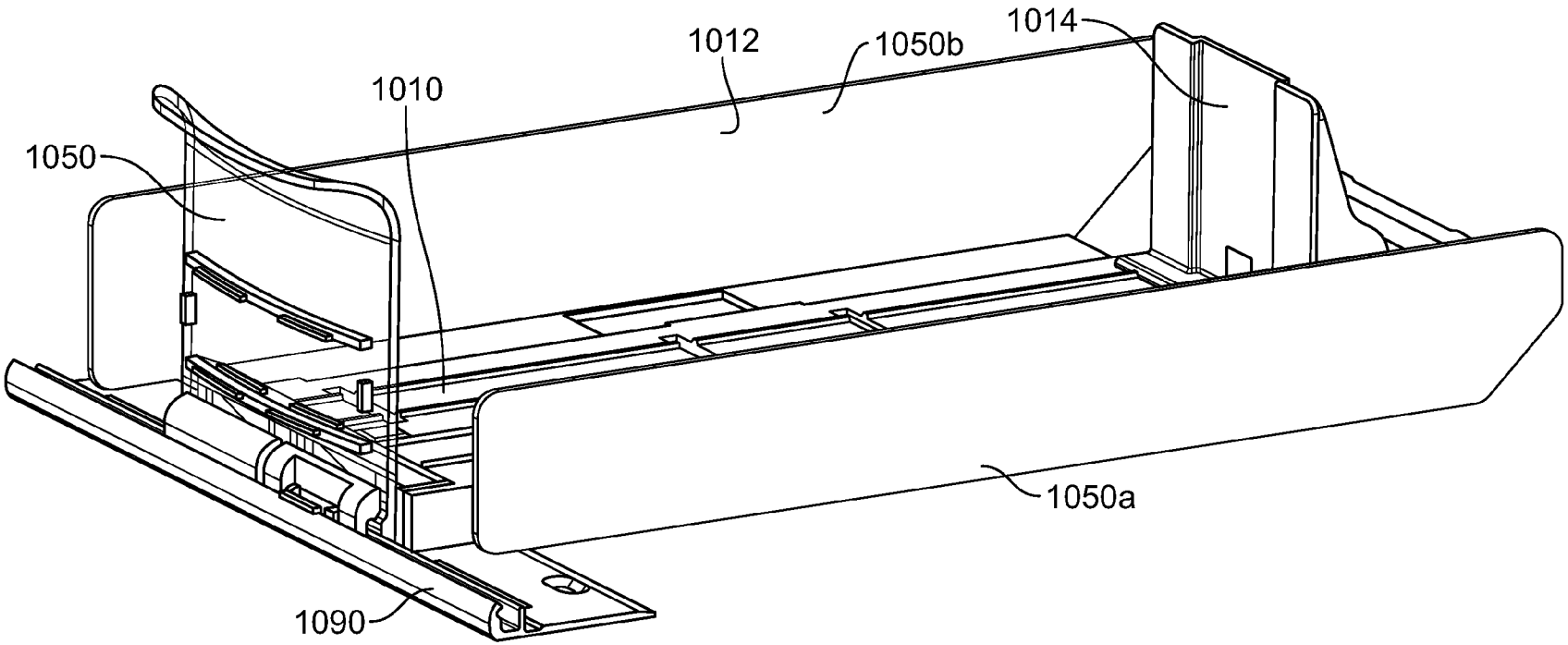
FIG. 7 shows the adjustable tray of FIG. 1 engaged with a front rail that can be located on a shelf.
Figure 8:
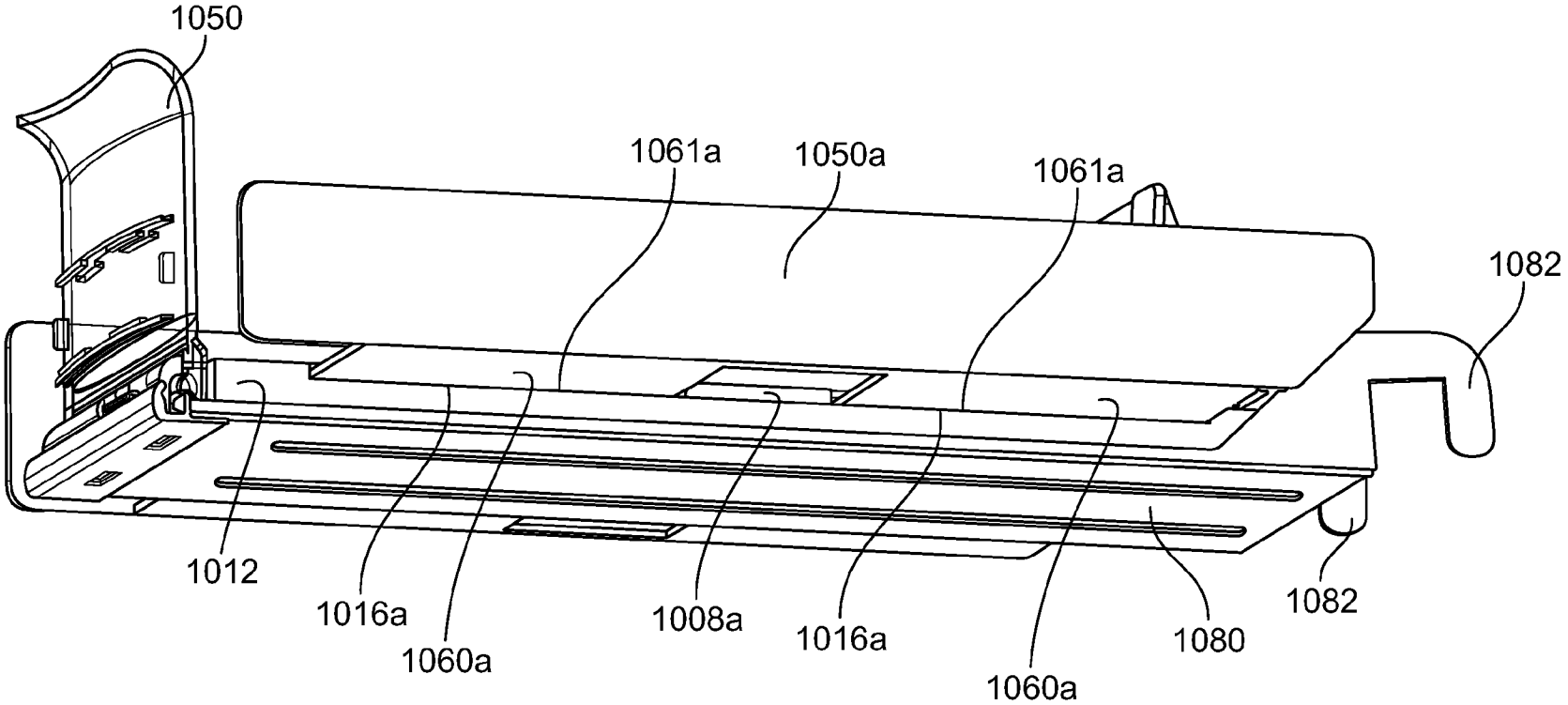
FIG. 8 shows the adjustable tray of FIG. 1 mounted to a hanger tray for engaging a hang bar in the rear of the shelf.
Figure 9:
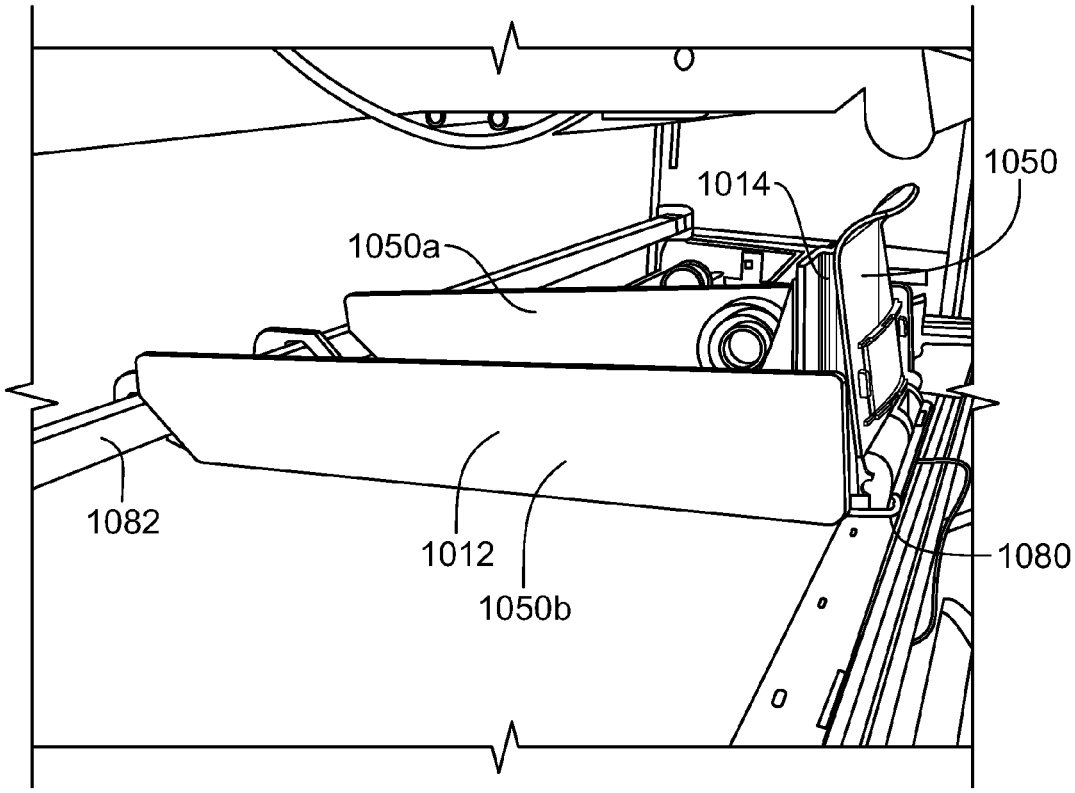
FIGS. 9 and 10 show the adjustable tray of FIG. 1 and the hanger tray mounted to a hang bar.
Figure 10:
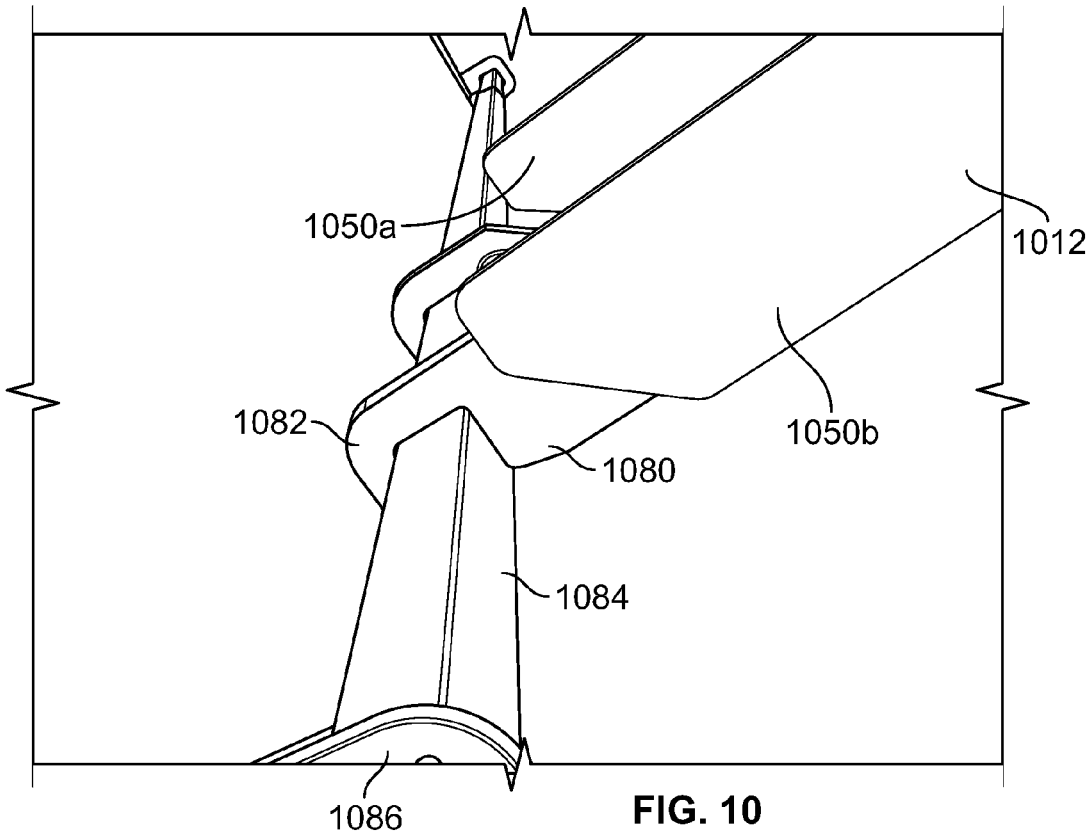
Figure 11:
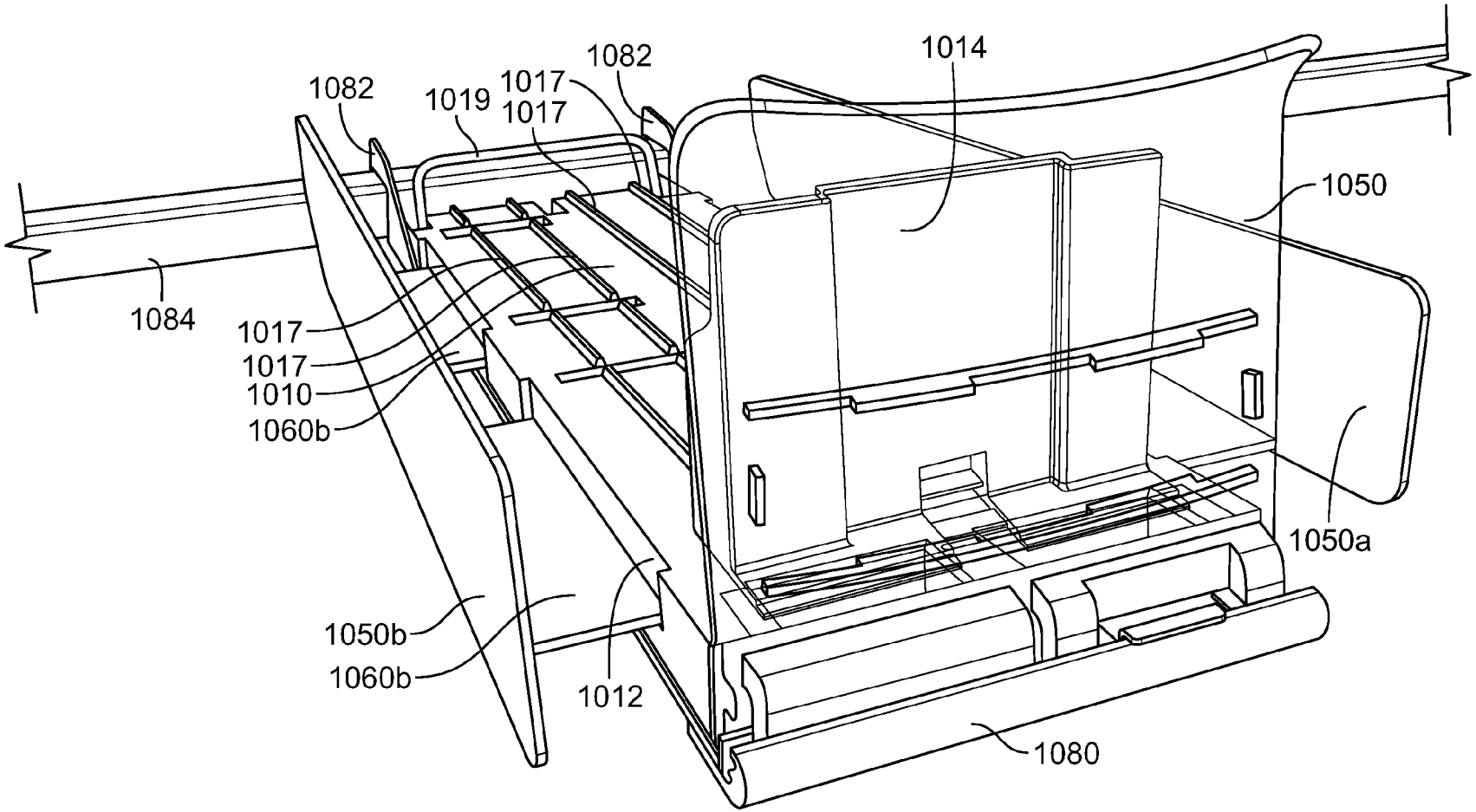
FIG. 11 shows a front view of the adjustable tray of FIG. 1 and the hanger tray mounted to a hang bar at the rear of a display.

FIG. 1 depicts an example of product management display system 1000 for merchandising product on a shelf or hang bar having an adjustable tray 1012. FIG. 1 shows a top isometric view of the adjustable tray 1012 secured to a hang-bar tray 1080 with the adjustable tray 1012 in an extended position. FIG. 2 shows a bottom view of the adjustable tray 1012 in an extended position without the hang-bar tray 1080. FIG. 3 shows a front view of the retainer 1050 and the adjustable tray 1012. FIG. 4 shows a front perspective view of the adjustable tray 1012 and the retainer 1050. FIGS. 5*a* and 5*b* show cross-sectional views of a front portion of the adjustable tray 1012 and the retainer 1050 in both an extended position and in a downward position. FIG. 6*a* shows a front view of the adjustable tray 1012 and an exemplary cam for securing the adjustable tray 1012 into place onto a shelf or a hanger tray. FIG. 6*b* is a magnified view of the portion identified in FIG. 6*a*. FIG. 7 shows the adjustable tray engaged with a front rail 1090 that can be located on a shelf, and FIG. 8 shows the adjustable tray 1012 mounted to a hanger tray for engaging a hang bar in the rear of the shelf. FIGS. 9 and 10 show the adjustable tray 1012 and the hanger tray 1080 mounted to a hang bar at the rear of a display. FIG. 11 shows a front view of the adjustable tray 1012 and the hanger tray mounted to a hang bar at the rear of a display.

The adjustable tray 1012 is configured to adjust the width of the adjustable tray 1012 to accommodate different sized products therein. In particular, a first divider 1050*a* and a second divider 1050*b* can both be moved laterally or horizontally with respect to a pusher mechanism 1014 such that the spacing between the first divider 1050*a* and the second divider 1050*b* is configured to be adjusted to accommodate various dimensioned products. As shown in FIG. 1, the adjustable tray 1012 can be formed as an integral assembly and can generally include a pair of dividers (first divider 1050*a*, second divider 1050*b*), a pusher mechanism 1014, a track 1016 for guiding the pusher mechanism, a tray surface 1010 first and second panels 1060*a* 1060*b*, and a retainer 1050.

The product can rest on the first panels 1060*a*, the second panels 1060*b*, and the tray surface 1010 and can be biased toward the retainer 1050 by the pusher mechanism 1014 using a coiled spring (not shown) in a similar manner to the examples shown and described in U.S. application Ser. No. 14/245,779, filed on Apr. 4, 2014, which is incorporated fully herein by reference. The retainer 1050 can be provided for limiting the movement of products loaded in the adjustable tray 1012 or the forward progression of the products loaded in the adjustable tray 1012 by the pusher mechanism 1014. The first panels 1060*a* and second panels 1060*b* can be configured to move to provide for additional tray surface area effectively extending the area of the tray surface 1010 for larger products when the dividers 1050*a*, 1050*b* are in the extended position. Also, the first divider 1050*a* can extend perpendicularly from the first panels 1060*a* and the second divider 1050*b* can extend perpendicularly from the second panels 1060*b*. Thus, the first divider 1050*a* can be formed together with the first panels 1060*a* and the second divider 1050*b* can be formed together with the second panels 1060*b* in a suitable forming operation. It is also contemplated that the first panels 1060*a* and/or the second panels 1060*b* can be formed as a singular panel or multiple panels.

Both the first panels 1060*a* and the second panels 1060*b* form first and second openings 1061*a*, 1061*b*. The adjustable tray 1012 can include first slot recesses 1016*a* for receiving first panels 1060*a* and second slot recesses 1016*b* for receiving second panels 1060*b*. The first and second openings 1061*a*, 1061*b* provide for additional rigidity or support on the adjustable tray 1012 in the areas 1008 located adjacent to the first and second slot recesses 1016*a*, 1016*b* receiving the first panels 1060*a* and the second panels 1060*b*. For example, as shown in FIG. 8, because of the first opening 1061*a*, the area 1008*a* on the adjustable tray 1012 adjacent to the first slot recesses 1016*a* can be provided with additional material which provides for additional rigidity or support. In particular, the adjustable tray 1012 in areas 1008*a*, 1008*b* adjacent to the first and second openings 1061*a*, 1061*b* of the first and second panels 1060*a*, 1060*b* are provided with a greater height than areas adjacent the first and second slot recesses 1016*a*, 1016*b* receiving the panels 1060*a*, 1060*b*. In this way, the tray can support the desired amount of weight and products. However, it is also contemplated that the first panels 1060*a* could be formed together as a unitary structure, and the second panels 1060*b* could be formed together as a unitary structure.

Additionally, the adjustable tray 1012 can be provided with one or more guide members 1021 for guiding and supporting the first panels 1060*a* and the second panels 1060*b* during adjustment of the dividers 1050*a*, 1050*b* on the adjustable tray 1012. The guide members 1021 can be formed with one or more ribs 1005 to provide for additional support of the first panels 1060*a* and the second panels 1060*b*. The guide members 1021 can be formed together with the adjustable tray 1012 or secured to the adjustable tray 1012 using any known securing method. Additionally, as shown in FIG. 1, the track can be provided with shut offs 1003 in the form of openings such that when forming the guide members 1021 undercuts are avoided during a molding operation.

As shown in FIG. 2, which is a bottom view of the exemplary adjustable tray 1012, an elongated guide shaft 1020 can extend from a rear portion of the adjustable tray 1002 to a front portion of the adjustable tray 1002. As shown in FIG. 3, the guide shaft 1020 can be provided with a plurality of guide shaft teeth 1025 that are configured to engage or mesh with a first set of teeth 1062*a* on the first panels 1060*a* and a second set of teeth 1062*b* on the second panels 1060*b*. The guide shaft 1020 can be configured to rotate on first and second pivots 1022*a*, 1022*b*. The guide shaft 1020 can be engaged with the first set of teeth 1062*a* and the second set of teeth 1062*b* such that when the dividers 1050*a*, 1050*b*, the first panels 1060*a*, and the second panels 1060*b* move to provide additional surface area for the products loaded therein, the adjustable tray 1012 maintains its symmetry by providing equalized spacing and movement of the dividers 1050*a*, 1050*b*.

Also, as shown in FIG. 3, in one example, the first set of teeth 1062*a* extend upward to engage the guide shaft teeth 1025, and the second set of teeth extend downward to engage the guide shaft teeth 1025. However, this arrangement can be reversed such that the first set of teeth extend downward toward the drive shaft teeth, and the second set of teeth extend upward toward the guide shaft teeth. As further shown in FIG. 3, the first panels 1060*a* can be provided with a first limiting member 1064*a* to limit the distance that the first panels 1060*a* and first divider 1050*a* can be extended from the adjustable tray 1012, and the second panels 1060*b* can be provided with a second limiting member 1064*b* for limiting the distance that the second panels 1060*b* can be extended from the adjustable tray 1012. In an alternative example, the guide shaft can be provided with wheels, textured surfaces, or other high friction surface instead of teeth. Also the corresponding panel surfaces can be provided with texted surfaces or high friction surfaces to engage the drive shaft.

To adjust the size of the adjustable tray, the user can simply push or pull on the dividers 1050*a*, 1050*b* to cause the first panels 1060*a* and the second panels 1060*b* to either extend from the adjustable tray 1012 or retract into the first and second slot recesses 1016*a*, 1016*b* respectively in the adjustable tray 1012. In this way, the adjustable tray can be adjusted to the appropriate size depending on the width of the product desired to be dispensed. The adjustable tray 1012 can also be provided with a handle 1019 such that the user can easily grasp the adjustable tray 1012 and place the adjustable tray 1012 into the desired location in a merchandising display system.

The track 1016 of the adjustable tray 1012 can include multiple guides 1017 for guiding the pusher mechanism 1014. The guides 1017 can restrict the pusher mechanism 1014 to horizontal movement and restricts vertical movement of the pusher mechanism 1014 along the track 1016. The pusher mechanism 1014 can be provided with corresponding grooves 1015 for receiving the guides 1017. The guides also serve to reduce the amount of frictional contact between the adjustable tray 1012 and the product therein to facilitate the product movement in the adjustable tray. The guides 1017 can also be formed as guide slots and the pusher mechanism can be formed with corresponding projections that extend into the guide slots. It is contemplated, however, that the pusher mechanism can also be a trackless pusher mechanism such as shown and described in the examples of U.S. application Ser. No. 14/245,779, for example.

Additionally, as shown in FIGS. 5*a* and 5*b*, the retainer 1050 can be configured to rotate from an upward position downwardly or to drop down with respect to the adjustable tray 1012. The retainer 1050 can include one or more teeth 1052 positioned at a lower front portion that can be configured to engage a pocket or void 1015 in the front portion of the adjustable tray 1012 to lock the retainer in place when product is biased toward the front of the adjustable tray 1012 by the pusher mechanism. A lip 1054 can also be formed adjacent to the void to assist in maintaining the retainer 1050 in the upward or first position. The retainer 1050 can include a top or front curved portion 1065 that provides the user with a greater capability to grasp the retainer 1050 so as to move the retainer from the upward position to the downward position.

The retainer 1050 can also be provided with one or more projections or feet 1056 that in an example can be formed as ramps that extend from the base of the retainer 1050. The projections 1056 can provide various functions. For example, the projections 1056 can provide the retainer 1050 with additional stability when the retainer 1050 is located in the extended or upward position as shown in FIG. 5*b*. In particular, the projections 1056 can fit into a recess 1058 located in the adjustable tray 1012, which the retainer is in the first or upright position. Additionally, the projections 1056 can be provided with a first angled portion 1055*a* that connects to a second flat portion 1055*b*. The second flat portion 1055*b* is configured to rest onto a corresponding flat surface 1013 on the adjustable tray 1012 when the retainer is in the upright position.

Additionally, when the retainer is in the second or downward position, as shown in FIG. 5*a*, the projections 1056 are configured to hold the retainer 1050 in the downward or horizontal position and to hold the product itself when the retainer 1050 is in the downward position. In particular, the second flat portion 1055*b* can be configured to hold the product on the shelf when the retainer 1050 is in the downward position. Also while the retainer 1050 is in the downward or second position as shown in FIG. 5*a*, the first angled portion 1055*a* provides a ramp for guiding products into the adjustable tray 1012. In one example, the retainer 1050 can be formed robust enough to withstand placement of a box or carton of product thereon while the product is loaded into the adjustable tray and over the first angled portion 1055*a*. Additionally, once the products are loaded into the adjustable tray, and the retainer is moved back into the upright or vertical position, the products slide down the first angled portion 1055*a* into the proper position on the adjustable shelf. The projections 1056 can, therefore, be configured to both hold products into the adjustable tray 1012 as products are loaded and also help guide products into the adjustable tray 1012 as products are loaded into the adjustable tray 1012.

The first angled portion 1055*a* and the second flat portion 1055*b* can together form a recess or groove 1057 in the base of the retainer 1050. The groove 1057 can receive a front curved portion 1059 of the adjustable tray 1012 therein to maintain the retainer 1050 in the horizontal position shown in FIG. 5*b*. As the retainer 1050 is held in the downward or second position shown in FIG. 5*a*, the second flat portion 1055*b* of the projections 1056 also acts as a stop or a retaining wall for limiting the movement of product that is loaded onto the adjustable tray 1012. The ability to convert from a tall retainer to a short retainer opens up access to make the loading process easier In order for the retainer 1050 to be moved into the down or second position, the user simply grasps the front curved portion 1065 of the retainer and pushes back on the retainer toward the rear of the adjustable tray 1012 such that the teeth 1052 can become disengaged with the void 1015. The user then lifts the retainer 1050 up to move the teeth 1052 out of contact with the void 1015 and the lip 1054 to drop the retainer 1050 down. The ability of the retainer 1050 to fold or drop down provides the user with the ability to reload the tray with a large amount of products at once with a carton or otherwise. Also the retainer 1050 can be designed to be robust such that a large carton or amount of products can be placed onto the retainer for loading the products. While the existing products remain onto the shelf due to the second flat portion 1055*b*, the user can slide the products over the retainer 1050 ramp formed by the first angled portion 1055*a* and the second flat portion 1055*b* to load the products onto the shelf.

In addition, in product settings where there is a lower ceiling or smaller head space between product rows, the ability of the retainer 1050 to move into the horizontal position eases the reloading of the product and unloading of the old product. This may also provide for easier product rotation, for example, the user can pull out all of the old product and the load new product onto the shelf and then reload the old product in front of the old product with ease.

As shown in FIGS. 6*a* and 6*b*, the adjustable tray 1012 can be provided with a cam 1070, which operates in a similar fashion as the examples described in U.S. application Ser. No. 14/245,779 to lock the adjustable tray 1012 to either a front rail as shown in FIG. 7 or the hanger tray 1080 as shown in FIG. 8. The tray 1012 can, thus, be used in conjunction with the examples disclosed in U.S. application Ser. No. 14/245,779 and can be mounted to the same front rail described therein along with any one of the pusher mechanisms and dividers described therein. Additionally, one or more ribs 1006 can be provided adjacent the cam 1070 on the underside of the adjustable tray 1012 to provide for additional rigidity and support of the adjustable tray 1012.

In one example, as shown in FIGS. 8 and 10, the hanger tray 1080 can be provided with one or more hangers 1082, which are configured to engage a hang bar 1084. The hanger tray 1080 can be provided with a void (not shown) in which a corresponding insert 1023 (shown in FIG. 2) on the adjustable tray 1012 can extend into to help lock the adjustable tray 1012 into place onto the hanger tray 1080 in conjunction with the cam 1070. Once secured to the hanger tray 1080, as shown in FIGS. 9-11, the adjustable tray 1012 can be suspended from the rear of the back wall of a merchandise display.

As shown in FIGS. 9 and 10, in one example, the hang bar 1084 may be a square tube with a short bracket 1086 attached to either end that fits into the gondola uprights of the shelf system. When installed into the gondola uprights, the hang bar usually can sit an inch or two from the back wall of the gondola. Individual product trays, or sometimes just long hooks or hangers (e.g. hangers 1082), are then attached to the hang bar and cantilever forward. With the use of hangers, the need for a shelf is eliminated. Additionally, the use of hangers allows one to position the product packages closer together vertically and often gives the product a "floating" appearance which may be desirable from a product marketing and management standpoint.

In one example, an adjustable tray for a merchandise display system can include one or more of: a retainer for limiting the movement of products loaded in the adjustable tray, a pusher mechanism configured to bias product toward the retainer, a first divider extending from a first panel perpendicular to the first divider, and a second divider extending from a second panel perpendicular to the second divider. The spacing between the first divider and the second divider can be configured to be adjusted, and the first panel and the second panel can be configured to move to provide additional surface area for the adjustable tray when the space between the first divider and the second divider is increased. The adjustable tray can be configured to mount to either a front rail or a hanger tray by a cam.

In another example a merchandise display system can include one or more of: a tray having a tray surface for receiving products loaded in the tray, a retainer for limiting the movement of products loaded in the tray, a first divider and a second divider for guiding the products in the tray, and a first panel defining a first panel surface and a second panel defining a second panel surface. The first panel surface and the second panel surface can provide for an extension to the tray surface, and the first divider can extend perpendicularly from the first panel and second divider can extend perpendicularly from the second panel. The spacing between the first divider and the second divider can be configured to be adjusted and the first panel and the second panel can be configured to move to provide the extension to the tray surface of the tray when a space between the first divider and the second divider is increased.

In an example, the adjustable tray may also include a guide shaft which can have a set of guide shaft teeth configured to engage a first set of teeth located on the first panel and a second set of teeth located on the second panel to provide equalized movement and spacing of the first divider and the second divider with respect to one another. The guide shaft can extends underneath the adjustable tray, and one of the first set of teeth or the second set of teeth extend upward to engage the guide shaft.

In an example, the retainer can be configured to rotate from an upward position to a downward position, and the barrier further comprises a projection configured to provide a ramp for loading product into the adjustable tray. The projection can be configured to limit the movement of product when the retainer is in the downward position. The projection can include an angled portion and a flat portion which together form groove, and the groove is configured to receive a front portion of the adjustable tray therein to maintain the retainer in the downward position. The retainer may also include a tooth configured to engage a void on the adjustable tray for holding the retainer in the upward position.

In one example, the first divider can extend from first panels and the second divider can extend from second panels, and the first panels can form a first opening and the second panels can form a second opening. First and second slot recesses can be provided for receiving the first panels and the second panels.

In one example, an adjustable tray for a merchandise display system can include one or more of: a retainer for limiting the movement of products loaded in the adjustable tray, a pusher mechanism configured to bias product toward the retainer, a first divider, and a second divider. The retainer can include a retainer wall for retaining products in a first position and a retainer projection configured to retain existing products on the shelf in a second position and to serve as a guide for products being loaded into the adjustable tray.

The projection can include a ramp for guiding the products into the tray when the retainer is in the second position, and the projection can include a flat surface adjacent to the ramp which helps prevent products loaded onto the shelf from advancing off of the tray when the retainer is in the second position. The first divider can be located on a first panel and the second divider can be located on a second panel. The spacing between the first divider and the second divider can be configured to be adjusted and the first panel and the second panel are configured to move to provide additional surface area for the adjustable tray when a distance between the first divider and the second divider is increased. The adjustable tray can be configured to mount to either a front rail or a hanger tray by a cam.

The retainer can be configured to rotate from the first position to the second position. The projection can be configured to limit the movement of product when the retainer is in the downward position. The projection can include an angled portion and a flat portion which together form groove and wherein the groove is configured to receive a front portion of the adjustable tray therein to maintain the retainer in the second position. The retainer further comprises a tooth configured to engage a void on the adjustable tray for holding the retainer in the first position.

Variations and modifications of the foregoing are within the scope of the present disclosure. For example, one of skill in the art will understand that multiples of the described components may be used in stores and in various configurations. The present disclosure is therefore not to be limited to a single system, nor the upright pusher configuration, depicted in the Figures, as the system is simply illustrative of the features, teachings and principles of the disclosure herein. It should further be understood that the concepts defined herein extends to all alternative combinations of two or more of the individual features mentioned or evident from the text and/or drawings. All of these different combinations constitute various alternative aspects of the present disclosure.

What is claimed is:

1. A merchandise display system comprising:

an adjustable tray having a base; the base of the tray having a top surface, a front surface, a rear surface and a pair of side walls, wherein the top surface of the base is configured to receive products loaded in the tray and support a pusher mechanism, wherein the each side wall of the base comprises at least one slot;

a retainer for limiting movement of products loaded in the tray;

a first divider and a second divider for guiding the products in the tray; and a first panel defining a first panel surface and a second panel defining a second panel surface, wherein the first panel and the second panel each comprise a distal end having a plurality of teeth, wherein the distal end of the first panel is inserted in a corresponding slot in one of the side walls of the base, and the distal end of the second panel is inserted in a corresponding slot in the other side wall of the base, wherein the first panel surface and the second panel surface each provide for an extension to the base of the tray, wherein the first divider extends perpendicularly from the first panel and second divider extends perpendicularly from the second panel, a rotatable guide shaft extending between the front and rear surfaces of the base of the tray, the guide shaft comprises a central axis and a plurality of teeth extending from the central axis, wherein the central axis of the guide shaft is generally perpendicular to the front and rear surfaces of the base of the tray;

wherein, when in use, the guide shaft teeth simultaneously mesh with the plurality of teeth on each of the first and second panels in a manner where the first and second panels are vertically spaced apart from each other, wherein rotation of the guide shaft in a first direction causes the first panel and the second panel to each move simultaneously in a lateral direction away from each other causing the first and second panels to extend away from the base of the tray thereby providing an extended platform and increasing a distance between the first and second dividers to enable the tray to accommodate larger products therein;

wherein rotation of the guide shaft in a second direction causes the first panel and the second panel to each move simultaneously in a lateral direction towards each other causing the first and second panels to retract within the base of the tray thereby decreasing the distance between the first and second dividers to enable the tray to accommodate smaller products therein.

2. The merchandise display system of claim 1 wherein the guide shaft extends underneath the base of the tray wherein the teeth on the first panel or the teeth on the second panel extend upward to engage the guide shaft.

3. The merchandise display system of claim 1 wherein the retainer is configured to rotate from an upward position to a downward position and wherein the retainer further comprises a projection configured to provide a ramp for loading product into the tray.

4. The merchandise display system of claim 3 wherein the projection is configured to limit movement of the products when the retainer is in the downward position.

5. The merchandise display system of claim 4 wherein the projection includes an angled portion and a flat portion which together form a groove and wherein the groove is configured to receive a front portion of the adjustable tray therein to maintain the retainer in the downward position.

6. The merchandise display system of claim 5 wherein the retainer further comprises a tooth configured to engage a void on the tray for holding the retainer in the upward position.

7. The merchandise display system of claim 1 wherein the tray is configured to mount to either a front rail or a hanger tray by a cam.

8. The merchandise display system of claim 1 wherein the first panel forms a first opening and the second panel forms a second opening.

9. The merchandise display system of claim 1 further comprising a pusher mechanism configured to bias the products toward the retainer.

* * * * *